US005581174A

United States Patent [19]

Fronen

[11] Patent Number: 5,581,174

[45] Date of Patent: Dec. 3, 1996

[54] BAND-GAP REFERENCE CURRENT SOURCE WITH COMPENSATION FOR SATURATION CURRENT SPREAD OF BIPOLAR TRANSISTORS

[75] Inventor: Robert J. Fronen, Eindhoven, Netherlands

[73] Assignee: U.S. Philips Corporation, New York, N.Y.

[21] Appl. No.: 349,112

[22] Filed: Dec. 2, 1994

[30] Foreign Application Priority Data

Dec. 3, 1993 [BE] Belgium ..... 9301335

[51] Int. Cl.[6] ..... G05F 3/16; G05F 3/20

[52] U.S. Cl. ..... 323/316; 323/314

[58] Field of Search ..... 323/315, 316, 323/250, 539, 538, 313, 314

[56] References Cited

U.S. PATENT DOCUMENTS

| | | | |
|---|---|---|---|
| Re. 30,586 | 4/1981 | Brokaw | 323/314 |
| 4,339,707 | 7/1982 | Gorecki | 323/313 |
| 4,808,908 | 2/1989 | Lewis et al. | 323/313 |
| 5,029,295 | 7/1991 | Bennett et al. | 323/313 |

OTHER PUBLICATIONS

"A Simple Three–Terminal IC Bandgap Reference", IEEE Journal of Solid–State, vol. SC–9, No. 6, Dec. 1974, A. P. Brokaw, pp. 388–393.

"Analysis and Design of Analog Integrated Circuits", Second Edition, John Wiley & Sons, Chapter 4, Appendix A4.3.2.

*Primary Examiner*—Peter S. Wong
*Assistant Examiner*—Bao Q. Vu
*Attorney, Agent, or Firm*—Steven R. Biren

[57] ABSTRACT

A reference current source for generating a reference current (Irf) includes a bipolar first transistor (2) and a bipolar second transistor (4), the base of the first transistor (2) being coupled to the base of the second transistor (4), a first resistor (6) connected between the emitter of the first transistor (2) and the emitter of the second transistor (4), and a second resistor (8) connected between the emitter of the second transistor (4) and a supply terminal (10). The current source also includes a measurement circuit (16) having inputs (12, 14) coupled to the collector of the first transistor (2) and the collector of the second transistor (4), and having a measurement output (18) for supplying a measurement signal in response to a difference in the collector current of the first transistor (2) and the second transistor (4), a bipolar third transistor (28) having its base coupled to the measurement output (18), having its emitter coupled to the bases of the first (2) and the second transistor, and having a collector supplying the reference current (Irf), and a bipolar fourth transistor (34) having its base coupled to the base of the third transistor (28), and having its emitter connected to the emitter of the third transistor (28) via a base pinch resistor (36). The base pinch resistor (36) provides compensation for variations in the reference current (Irf) caused by spread in the saturation current of the bipolar transistors.

6 Claims, 3 Drawing Sheets

BAND-GAP REFERENCE CURRENT SOURCE WITH COMPENSATION FOR SATURATION CURRENT SPREAD OF BIPOLAR TRANSISTORS

BACKGROUND OF THE INVENTION

The invention relates to a reference current source for generating a reference current, comprising:

—a bipolar first transistor and a bipolar second transistor, each having a base, an emitter and a collector, the base of the first transistor being coupled to the base of the second transistor;

—a first resistor connected between the emitter of the first transistor and the emitter of the second transistor;

—a supply terminal;

—a second resistor connected between the emitter of the second transistor and the supply terminal;

—measurement means having inputs coupled to the collector of the first transistor and the collector of the second transistor, and having a measurement output for supplying a measurement signal in response to a difference in the collector current of the first transistor and the second transistor; and —a bipolar third transistor having a base coupled to the measurement output, having an emitter coupled to the bases of the first and the second transistor, and having a collector for supplying the reference current.

Such a reference current source is known from the IEEE Journal of Solid-State Circuits, Vol. SC-9, No. 6, December 1974, A. P. Brokaw "A Simple Three-Terminal IC Bandgap Reference", incorporated herein by reference, pp 388–393, in particular FIGS. 2 and 3. FIG. 2 of the IEEE reference shows a measurement means comprising a differential amplifier having an output connected to the measurement output and having inputs connected to the collectors of the first transistor and the second transistor, a first collector resistor connected between the collector of the first transistor and a further supply terminal, and a second collector resistor connected between the collector of the second transistor and the further supply terminal. FIG. 3 of IEEE reference shows a measurement means comprising a current mirror having an input branch coupled to the collector of the first transistor and having an output branch coupled to the collector of the second transistor and to the measurement output, the input branch and the output branch forming the inputs of the measurement means. In this known reference current source the first and the second transistor operate at different current densities, which is maintained with the aid of the measurement means. The difference between the base-emitter voltages of the first and the second transistor appears across the first resistor as a voltage which is directly proportional to the absolute temperature. As a consequence, the collector currents of the first and the second transistor are also directly proportional to the absolute temperature. The sum of the collector currents flows through the second resistor and generates across this second resistor a voltage which is also directly proportional to the absolute temperature. The voltage on the base of the second transistor is the sum of the base-emitter voltage of the second transistor, which has a negative temperature coefficient and the voltage across the second resistor, which has a positive temperature coefficient. This yields a sum voltage, referred to as the band-gap voltage, whose value is substantially temperature independent over a wide temperature range.

The base-emitter voltage of the second transistor decreases as the saturation current of the second transistor increases. This follows from the well-known relationship between the base-emitter voltage and the collector current of a bipolar transistor. The saturation current of a bipolar transistor is determined by a variety of process parameters which are subject to spread. As a result, the generated band-gap voltage will not have the desired temperature dependence over a specified temperature range and, moreover, the nominal value of the band-gap voltage and hence the nominal value of the reference current derived therefrom will exhibit a spread.

SUMMARY OF THE INVENTION

It is an object of the invention to provide a reference current source which is less sensitive to the spread in the saturation current of the bipolar transistors used in this current source.

To this end, according to the invention, a reference current source of the type defined in the opening paragraph is characterized in that the reference current source further comprises:

—a base pinch resistor; and

—a bipolar fourth transistor having a base coupled to the base of the third transistor, and having an emitter connected to the emitter of the third transistor via the base pinch resistor.

Use is made of the principle that the spread in the saturation current is correlated with the spread in the value of a base pinch resistor (also referred to as pinched base resistor), which value is proportional to the saturation current and has a positive dependence on the absolute temperature. Consequently, the current flowing through a base pinch resistor connected to a supply voltage which is proportional to the absolute temperature decreases as the saturation current increases. The difference between the base-emitter voltages of the bipolar third and fourth transistors forms a supply voltage source with the desired thermal characteristics, so that a correction current which decreases as the saturation current increases and vice versa flows through the base pinch resistor. This correction current reduces the reference current available at the collector of the third transistor. Thus, the reference current is compensated for the spread in the saturation current.

The temperature dependence of the base pinch resistor and hence of the correction current is not perfectly linear. In accordance with the invention this can be corrected in that the emitter of the third transistor is coupled to the supply terminal via a third resistor of which at least a fraction has a temperature-dependent value.

BRIEF DESCRIPTION OF THE DRAWING

These and other aspects of the invention will now be described and elucidated with reference to the accompanying drawings, in which.

In the Figures like parts bear the same reference symbols.

DESCRIPTION OF THE PREFERRED EMBODIMENTS

Figure 1:
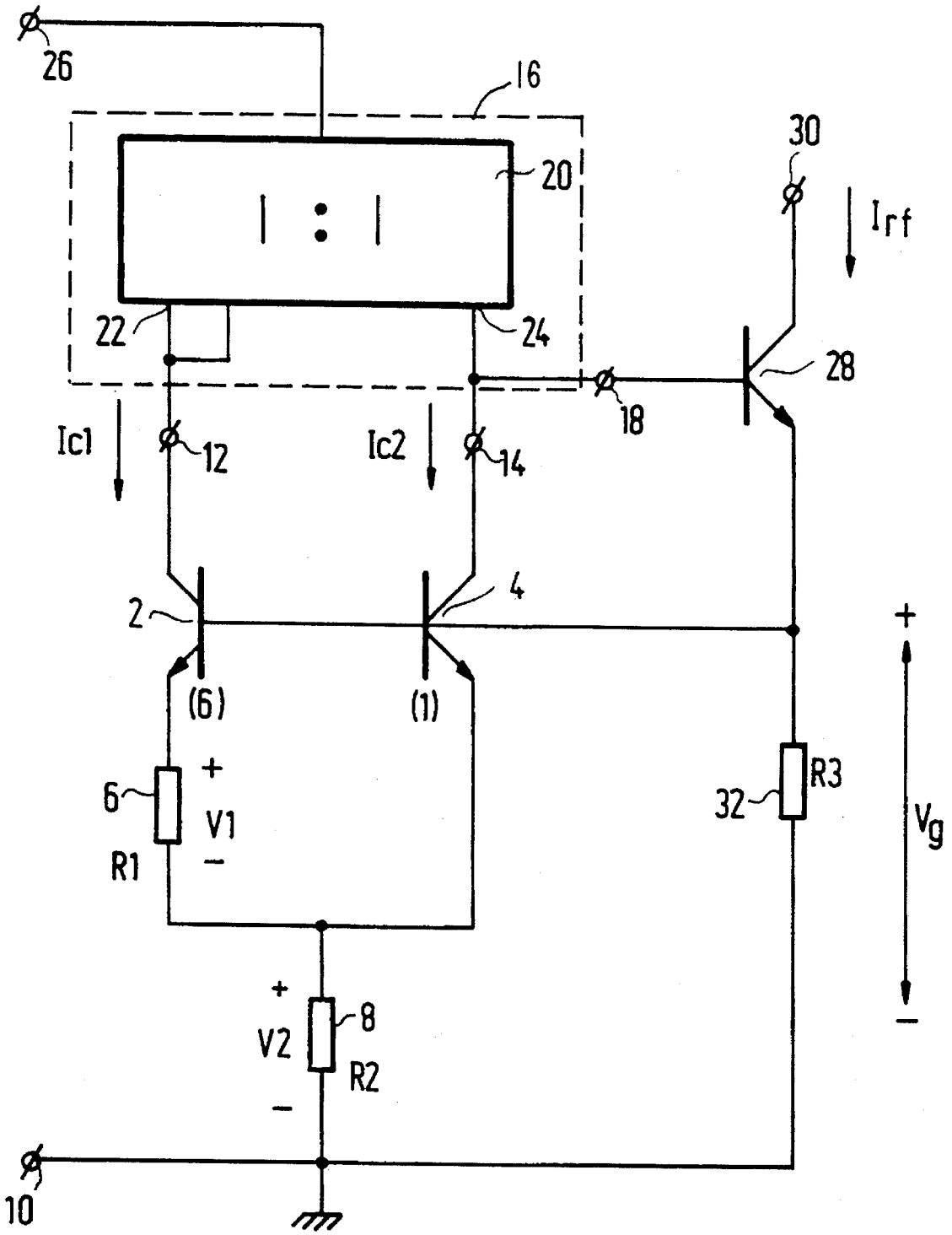
FIG. 1 shows a prior-art band-gap reference current source.

FIG. 1 shows a conventional band-gap reference current source arrangement. The circuit arrangement comprises a bipolar first transistor 2 and a bipolar second transistor 4 whose emitter areas are selected to be different. The relative emitter areas are indicated by parenthesized figures. By way of example the emitter area of the first transistor 2 is selected to be six times as large as the emitter area of the second transistor 4. A first resistor 6 is arranged in series with the emitter of the first transistor 2. The base-emitter junction of the second transistor 4 is connected in parallel with the series arrangement of the base-emitter junction of the first transistor 2 and the first resistor 6. To this end the bases of the first transistor 2 and the second transistor 4 are interconnected and the first resistor 6 is interposed between the emitter of the first transistor 2 and the emitter of the second transistor 4. The emitter of the second transistor 4 is also connected to a first supply terminal 10 via a second resistor 8, which first supply terminal is connected to signal ground. The collector of the first transistor 2 is connected to an input 12 and the collector of the second transistor 4 is connected to an input 14 of measurement means 16. The measurement means 16 have a measurement output 18, which supplies a measurement signal which is a function of the difference in the collector current Ic1 of the first transistor 2 and the collector current Ic2 of the second transistor 4. In the present case the measurement means 16 by way of example comprise a 1:1 current mirror 20 having an input branch 22 coupled to the collector of the first transistor 2 and having an output branch 24 coupled to the collector of the second transistor 4 and to the measurement output 18. The current mirror 20 is further connected to a second supply terminal 26 to receive a suitable operating voltage. The circuit arrangement further comprises a bipolar third transistor 28 having its base connected to the measurement output 18, having its emitter coupled to the bases of the first transistor 2 and the second transistor 4, and having its collector coupled to an output terminal 30 to supply a reference current Irf. The emitter of the third transistor 28 is connected to the first supply terminal 10 via a third resistor 32. It is to be noted that in the present circuit arrangement and the circuit arrangements to be described hereinafter the bases of the first transistor 2 and the second transistor 4 may alternatively be connected to a tap of the third resistor 32.

The current mirror 20 maintains the collector currents Ic1 and Ic2 equal so that the current density J1 in the emitter of the first transistor 2 is smaller than the current density J2 in the emitter of the second transistor 4. This results in a difference V1 between the base-emitter voltage Vbe1 of the first transistor 2 and the base-emitter voltage Vbe2 of the second transistor 4, which complies with:

$$V1 = \frac{kT}{q} \ln \frac{J2}{J1} = V_T \ln \frac{J2}{J1} \tag{1}$$

In this formula k is Boltzmann's constant, T is the absolute temperature, q is the elementary charge, and $V_T$ is the thermal potential. The voltage difference V1 appears across the first resistor 6. Since the collector currents of the first transistor 2 and the second transistor 4 are equal the current through the second resistor 8 is twice as large as the current through the first resistor 6. The voltage V2 across the second resistor 8 is then given by:

$$V2 = 2\frac{R2}{R1} V_T \ln \frac{J2}{J1} \tag{2}$$

Herein R1 is the value of the first resistor 6 and R2 is the value of the second resistor 8. The voltage V2 varies proportionally to the temperature T and compensates for the negative temperature coefficient of the base-emitter voltage Vbe2 of the first transistor 2. This results in a sum voltage Vg at the base of the second transistor 4, which voltage is substantially temperature independent over a wide temperature range. This yields a thermally stable reference current Irf at the output terminal 30, the magnitude of this current being determined by the voltage Vg and the value R3 of the third resistor 32. The base-emitter voltage Vbe2 depends on the saturation current Is of the second transistor 4 and may be written as follows:

$$Vbe2 = V_T \ln \frac{Ic2}{Is} = V_T \ln \frac{Ic1}{Is} = V_T \ln \left[ \frac{1}{Is} \cdot \frac{V1}{R1} \right] = V_T \ln \left[ \frac{1}{Is} \cdot \frac{V_T \ln \frac{J2}{J1}}{R1} \right] \tag{3}$$

The base-emitter voltage Vbe2 of the second transistor 4 consequently depends on the saturation current Is, whose value varies as a result of the spread in the parameters of the transistor fabrication process. The result is that the voltage Vg and hence the reference current Irf exhibits not only another nominal value than anticipated but also another temperature characteristic. In order to reduce these undesirable effects the principle is utilised that the spread in the saturation current Is of the transistors is correlated with the spread in value of a base pinch resistor fabricated in the same process. The value Rp of a base pinch resistor is proportional to the saturation current Is and inversely proportional to the absolute temperature T in accordance with the following formulas:

$$Is \mp L_e W_e q n_i^2 kT \mu_n / (q N_b W_b) \approx W_e^2 2 q n_i^2 2\, kT \mu_n \mu_p Rp \tag{4}$$

Here, $L_e$ and $W_e$ are the length and the width of the emitter, $W_b$ is the base thickness, and T is the absolute temperature. The other symbols represent physical material data. It appears that the value of a base pinch resistor is proportional to the saturation current Is. Equation (3) shows that the base-emitter voltage Vbe2 increases as the saturation current Is decreases. The voltage Vg and hence the reference current Irf then also increase when the saturation current decreases. This increase of Irf can be corrected by injecting into the third resistor 32 a correction current Icr which increases as the saturation current Is decreases. This current is supplied by a base pinch resistor, which is connected to a supply voltage which is proportional to the absolute temperature. This last-mentioned step is necessary to eliminate the effect of the temperature T in the resistance value Rp of the base pinch resistor.

Figure 2:
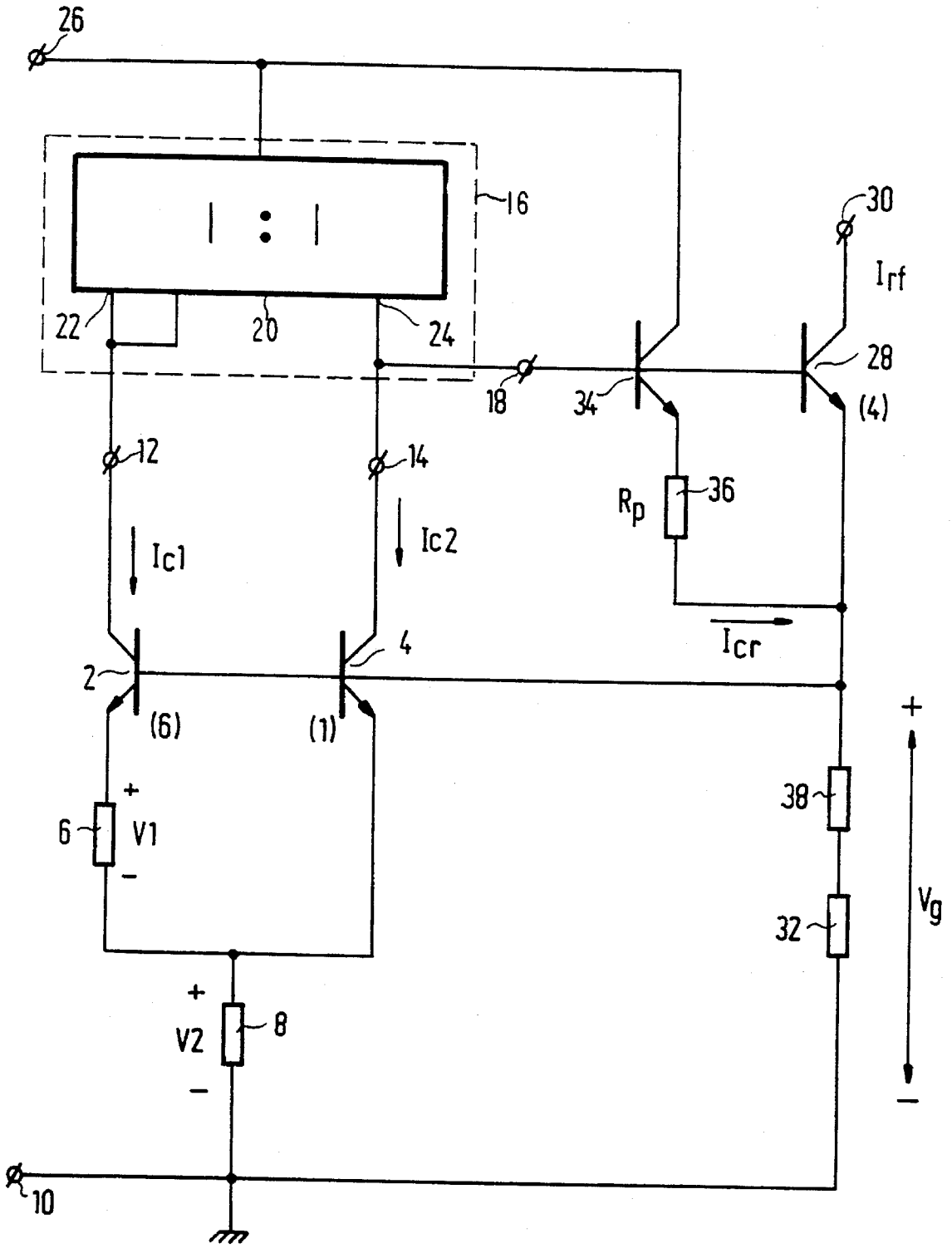
FIG. 2 shows a first embodiment of a band-gap reference current source in accordance with the invention.

FIG. 2 shows how the correction current Icr is generated. The circuit arrangement shown in FIG. 1 is extended with a bipolar fourth transistor 34 and a base pinch resistor 36 connected between the emitter of the fourth transistor 34 and the emitter of the third transistor 28. The base of the fourth transistor 34 is connected to the base of the third transistor 28 and the collector of the fourth transistor 34 is connected to a suitable supply voltage, for example from the second supply terminal 26. The difference between the base-emitter voltages of the third transistor 28 and the fourth transistor 34 constitutes a supply voltage source with the desired thermal characteristics, so that through the base pinch resistor 36 a correction current Icr flows which decreases as the saturation current increases and vice versa. This correction current reduces the reference current Irf available at the collector of the third transistor 28 because the voltage at the emitter of the third transistor 28 is fixed. In this way the reference current Irf is compensated for the spread in the saturation current Is of the transistors used.

The temperature dependence of the value Rp of the base pinch resistor 36 and hence that of the correction current Icr are not perfectly linear. If desired, a correction for this may be provided by arranging a temperature dependent resistor 38 in series with the third resistor 32.

Figure 3:
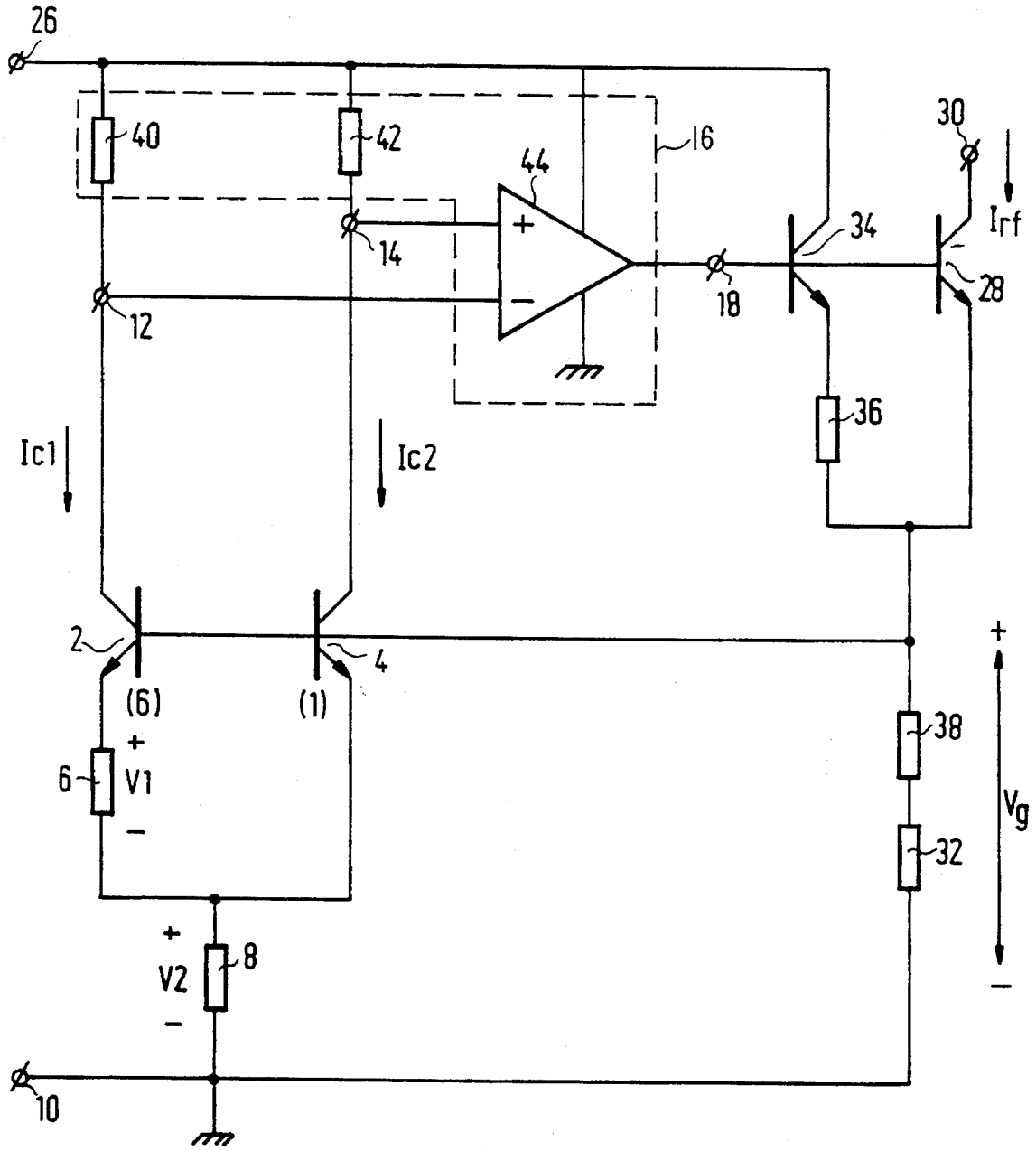
FIG. 3 shows a second embodiment of a band-gap reference current source in accordance with the invention.

FIG. 3 shows an alternative circuit arrangement in which the measurement means comprise a first collector resistor 40 in the collector lead of the first transistor 2, a second collector resistor 42 in the collector lead of the second transistor 4, and a differential amplifier 44 having its inputs connected to the resistor 40 and the resistor 42 and having its output connected to the measurement output 18. The resistance values of the resistor 40 and the resistor 42 are equal, so that in this case the collector currents of the first transistor 2 and the second transistor 4 are again equal.

The construction and operation of the band-gap arrangement shown in FIG. 1 are described comprehensively in the afore-mentioned article in the IEEE Journal of Solid State Circuits. The general principles of the band-gap arrangement and the construction of base pinch resistors are known from the handbooks. For the band-gap principles reference is made to P. R. Gray, R. G. Meyer, "Analysis and Design of Analog Integrated Circuits", Second Edition, John Wiley & Sons, Chapter 4, Appendix A4.3.2. For the base pinch resistor reference is made to Chapter 2, section 2.5.1. of the same handbook.

I claim:

1. A reference current source for generating a reference current, comprising:

a bipolar first transistor (2) and a bipolar second transistor (4), each having a base, an emitter and a collector, the base of the first transistor (2) being coupled to the base of the second transistor (4);

a first resistor (6) connected between the emitter of the first transistor (2) and the emitter of the second transistor (4);

a supply terminal (10);

a second resistor (8) connected between the emitter of the second transistor (4) and the supply terminal (10);

measurement means (16) having inputs (12, 14) coupled to the collector of the first transistor (2) and the collector of the second transistor (4), and having a measurement output (18) for supplying a measurement signal in response to a difference in the collector current of the first transistor (2) and the second transistor (4); and a bipolar third transistor (28) having a base coupled to the measurement output (18), having an emitter coupled to the bases of the first (2) and the second (4) transistor, and having a collector for supplying the reference current, characterized in that the reference current source further comprises:

a base pinch resistor (36); and a bipolar fourth transistor (34) having a base coupled to the base of the third transistor (28), and having an emitter connected to the emitter of the third transistor (28) via the base pinch resistor (36).

2. A reference current source as claimed in claim 1, characterized in that the emitter of the third transistor (28) is coupled to the supply terminal (10) via a third resistor (32) of which at least a fraction (38) has a temperature-dependent value.

3. A reference current source as claimed in claim 1, characterized in that the measurement means (16) comprises a current mirror (20) having an input branch (22) coupled to the collector of the first transistor (2) and having an output branch (24) coupled to the collector of the second transistor (4) and to the bases of the third (28) and the fourth (34) transistor.

4. A reference current source as claimed in claim 1, characterized in that the measurement means (16) comprises a differential amplifier (44) having an output connected to the measurement output (18) and having inputs connected to the collectors of the first transistor (2) and the second transistor (4), a first collector resistor (40) connected between the collector of the first transistor (2) and a further supply terminal (26), and a second collector resistor (42) connected between the collector of the second transistor (4) and the further supply terminal (26).

5. A reference current source as claimed in claim 2, characterized in that the measurement means (16) comprises a current mirror (20) having an input branch (22) coupled to the collector of the first transistor (2) and having an output branch (24) coupled to the collector of the second transistor (4) and to the bases of the third (28) and the fourth (34) transistor.

6. A reference current source as claimed in claim 2, characterized in that the measurement means (16) comprises a differential amplifier (44) having an output connected to the measurement output (18) and having inputs connected to the collectors of the first transistor (2) and the second transistor (4), a first collector resistor (40) connected between the collector of the first transistor (2) and a further supply terminal (26), and a second collector resistor (42) connected between the collector of the second transistor (4) and the further supply terminal (26).

* * * * *